US006313755B1

(12) United States Patent
Hetmaniak et al.

(10) Patent No.: US 6,313,755 B1
(45) Date of Patent: Nov. 6, 2001

(54) DOWNHOLE BURIED UTILITY SENSING AND DATA TRANSMISSION SYSTEM AND METHOD

(75) Inventors: J. Christopher Hetmaniak; William J. McDonald; Gerard T. Pittard, all of Houston, TX (US)

(73) Assignee: Maurer Engineering, Inc., Houston, TX (US)

( * ) Notice: Subject to any disclaimer, the term of this patent is extended or adjusted under 35 U.S.C. 154(b) by 0 days.

(21) Appl. No.: 09/324,810

(22) Filed: Jun. 2, 1999

Related U.S. Application Data

(60) Provisional application No. 60/087,679, filed on Jun. 2, 1998.

(51) Int. Cl.[7] ..... G01V 3/00

(52) U.S. Cl. ..... 340/856.3; 340/856.1; 172/5; 37/348

(58) Field of Search ..... 340/856.3, 856.1, 340/853.4; 212/280; 172/5, 6; 175/40, 45; 701/50; 37/348

(56) References Cited

U.S. PATENT DOCUMENTS 5,914,602 * 6/1999 Mercer ..... 324/326
6,003,376 * 12/1999 Burns et al. ..... 73/584
6,191,585 * 2/2001 Mercer et al. ..... 324/326

* cited by examiner

*Primary Examiner*—Timothy Edward, Jr.
(74) *Attorney, Agent, or Firm*—Kenneth A. Roddy

(57) ABSTRACT

A downhole buried utility sensing and data transmission system for connection at the lower end of a drill string has sensors capable of detecting the existence of various different types of buried utilities and objects and making calculations as to the radial separation distance between the detected utilities and the drill head and transmitting data between the down hole drill head to the surface. The sensors respond to material properties used to construct the utility lines or the energy fields created by the operation of these lines (pipes and cables) or from the energy associated with transmission of the particular utility service, including sound energy resulting from fluid flow and electromagnetic energy from electric currents. The system can detect and distinguish the presence of ferromagnetic metallic objects including steel pipes and structures; non-metallic utility infrastructure including gas pipelines, concrete sewer lines, telecommunication lines, and cable systems outfitted with RF tracer lines and transmitters; energized AC and DC power cable systems; and determining the approximate range, relative azimuth, and elevation of the sensors relative to the detected utility or object. The system also supports automatic cessation of drilling operations by combining the warning information with microprocessor control of drill string rotation and thrust.

12 Claims, 6 Drawing Sheets

Calculation of Range X to Cable

Magnetometer AC Output Voltages vs. Distance from Cable

O-RINGS
46
45
40
41
42
46
O-RINGS
PC BOARD INTERCONNECTS 40
7
46
42
PRINTED CIRCUIT BOARDS
41
MILLED FLATS FOR MOUNTING CIRCUIT BOARDS
46
7

48
MULTI CONDUCTOR CABLE TO DATA TELEMETRY SYSTEM AND POWER SUPPLY
47
46
40
44
17, 27, 34
OBSTACLE DETECTION SENSOR REARWARD SET
45
43
46
16, 26, 33
OBSTACLE DETECTION SENSOR FORWARD SET

DOWNHOLE BURIED UTILITY SENSING AND DATA TRANSMISSION SYSTEM AND METHOD

CROSS REFERENCE TO RELATED APPLICATION

This application claim priority of U.S. Provisional Application Ser. No. 60/087,679, filed Jun. 2, 1998.

BACKGROUND OF THE INVENTION

1. Field of the Invention

This invention relates generally to downhole obstacle sensing and data communication systems for guided boring and drilling apparatus, and more particularly to a downhole buried utility sensing and data transmission system having sensors capable of detecting the existence of various different types of buried utilities and objects and making calculations as to the radial separation distance between the detected utilities and the drill head and transmitting data between the down hole drill head to the surface.

2. Brief Description of the Prior Art

Since its inception into the underground utility construction industry, guided boring technology has experienced rapid advances and evolution in the types of systems available and the diameters, distances and accuracies to which underground utilities can be installed. Guided boring requires the capability to control hole direction and monitor its position in space. Currently, most guided boring systems utilize "pipe locators" to track the physical location and orientation of the boring head. These "pipe locators" consist of a small active transmitter placed in or near the drill head and a pair of highly tuned receiver coils. The devices are low cost and provide reasonably accurate data. There main limitations are the need for surface access along the route of the bore to take readings and their relatively shallow depth capability.

Solid-state compasses known as "steering tools" are also used for tracking and guidance of boring tools when economics and work conditions allow. These steering tools are significantly more expensive than "pipe locators" and require an insulated wire connecting the down hole instrumentation to the surface.

More recently, wireless systems, referred to generically as "Measurement-While-Drilling" (MWD) systems have been developed. The MWD systems provide wellbore directional data without requiring an insulated hard wire link to bring information to the surface. The wireless MWD systems provide improved reliability, simpler operation, higher speed, greater directional control and longer distances and they accommodate a greater range of hole sizes.

In spite of the industry's advances in guidance technology, there is no method of employing sensors down hole to detect the presence of buried utilities in the immediate vicinity of the drill head and communicate this information to the surface utilizing the "pipe locator", steering tool or MWD directional guidance platforms. Rather, the present state of the art is to dig test holes to physically confirm the exact location of other buried utilities or to employ "one call" location services which use walkover line tracing technologies to locate the approximate position of energized power cables or telecommunications lines on which has been imposed a fixed frequency signal. The problems with these systems are the requirement for surface access, which may impose safety risks in the case of highway crossings, or is impractical in the case of river crossings which support a lot of shipping activity. In addition, current devices do not operate in real time and therefore are of little use if the actual drill path varies from the path previously scanned for utilities. Finally, the devices do not provide accurate calculation of physical location which increases the likelihood of inadvertent strike.

McDonald et al, U.S. Pat. No. 5,467,083, which patent is hereby incorporated herein in its entirety by reference, discloses a wireless downhole electromagnetic data transmission system that impresses a digitally encoded message upon the drill string using frequency shift keying of the electromagnetic waves. The transmitted message is picked off at the surface by a signal receiver-demodulator unit and gravity and magnetic field vectors are combined with the hole length to calculate x, y, and z hole coordinates and derive hole position vectors and the presence of energized AC and DC power cables in the immediate vicinity of the boring head. The present invention is a significant improvement over this patent in that with the present system, the sensors respond to stimuli based on the materials used to construct the utility lines (pipes and cables) or from the energy associated with transmission of the particular utility service and the demodulated message provides specific information related to the particular different types of buried utilities detected, the level of alarm and the distance between the drill head and the obstacles. The present system may be used with an electromagnetic data transmission system such as that described in U.S. Pat. No. 5,467,083, an RF system such as used with locator sondes, or other suitable systems using well known encoding protocols for steering the tool and transmitting the information to the control point, for example; phase shift keying, pulse width modulation, amplitude modulation or frequency shift keying. The data can also be communicated using a direct wire line link which transmits analog or digitally encoded data.

The present invention is distinguished over prior art in general by a downhole buried utility sensing and data transmission system disposed at the lower end of a drill string and having sensors capable of detecting the existence of various different types of buried utilities and objects and making calculations as to the radial separation distance between the detected utilities and the drill head and transmitting data between the down hole drill head to the surface. The sensors respond to material properties used to construct the utility lines or the energy fields created by the operation of these lines (pipes and cables) or from the energy associated with transmission of the particular utility service, including sound energy resulting from fluid flow and electromagnetic energy from electric currents. The system can detect and distinguish the presence of ferromagnetic metallic objects including steel pipes and structures; non-metallic utility infrastructure including gas pipelines, concrete sewer lines, telecommunication lines, and cable systems outfitted with RF tracer lines and transmitters; energized AC and DC power cable systems; and determining the approximate range, relative azimuth, and elevation of the sensors relative to the detected utility or object. The system also supports automatic cessation of drilling operations by combining the warning information with microprocessor control of drill string rotation and thrust.

SUMMARY OF INVENTION

It is therefore an object of the present invention to provide a downhole buried utility sensing and data transmission system with sensors capable of detecting the existence and location of buried utilities in close proximity to the drill head.

It is another object of the present invention to provide a downhole buried utility sensing and data transmission system which will send information and warning signals to the surface operator relative to the location of buried utilities to prevent inadvertent contact between the drill head and buried utilities.

Another object of this invention is to provide a downhole buried utility sensing and data transmission system which will scan both radially around the drill head and axially in front of the drill head to assure sufficient clearance between buried utilities and the pilot hole drill head and the final size hole created through successive back reaming operations.

Another object of this information is to provide a downhole buried utility sensing and electromagnetic data transmission system that employs microprocessor controlled data acquisition and analysis so detection of buried utilities can be done in essentially real-time as normal guided boring operations progress.

Another object of this invention is to provide a downhole buried utility sensing and data transmission system with sensors capable of detecting physical properties associated with the construction and/or operation of buried utilities wherein the sensors are integrated with guided boring head tracking systems such as pipe locators, wireline steering tools and measurement-while-drilling systems.

Another object of this invention is to provide a downhole buried utility sensing and data transmission system having multiple, spatially oriented sensing elements to allow mathematical computation and estimation of the radial separation distance between a particular buried utility and the drill head.

Another object of this invention is to provide a downhole buried utility sensing and electromagnetic data transmission system that employs one or more magnetometers to measure the magnetic field components generated from current flow through cables energized with direct or alternating current.

Another object of this invention is to provide a downhole buried utility sensing and data transmission system that employs one or more magnetometers to measure the magnetic field components and the field component distortions caused by the presence of ferrous materials in the underground environment.

Another object of this invention is to provide a downhole buried utility sensing and data transmission system that employs one or more sensors to measure the electric fields associated with the operation of energized direct and alternating current power cables.

Another object of this invention is to provide a downhole buried utility sensing and data transmission system which will combine information obtained from magnetometers and electric field measurement coils to differentiate between ferrous materials and energized cables.

Another object of this invention is to provide a downhole buried utility sensing and data transmission system that employs tuned radio frequency receivers in the drill head capable of detecting the presence and location of lines carrying known frequency tracing carrier signals in the range from 1 Hz to 400 Khz.

Another object of this invention is provide a downhole buried utility sensing and electromagnetic data transmission system having non-metallic slots or holes in the external housing of the obstacle sensor system in the immediate vicinity of the electromagnetic field measuring sensors to provide minimal shielding of the energy propagation from the utility to the sensors.

Another object of this invention is to provide a downhole buried utility sensing and electromagnetic data transmission system having controls on the surface drill rig which automatically stop the rotation and forward advance of the drill head to prevent contact with buried utilities or other underground obstacles without human intervention.

A still further object of this invention is to provide a downhole buried utility sensing and data transmission system which will generate microprocessor interrupts that modify the normal directional-only data to include information on the type(s) and location of buried utilities and other types of obstacles.

Other objects of the invention will become apparent from time to time throughout the specification as hereinafter related.

The above noted objects and other objects of the invention are accomplished by a downhole buried utility sensing and data transmission system disposed at the lower end of a drill string, and having sensors capable of detecting the existence of various different types of buried utilities and objects and making calculations as to the radial separation distance between the detected utilities and the drill head and transmitting data between the down hole drill head to the surface. The sensors respond to material properties used to construct the utility lines or the energy fields created by the operation of these lines (pipes and cables) or from the energy associated with transmission of the particular utility service, including sound energy resulting from fluid flow and electromagnetic energy from electric currents. The system can detect and distinguish the presence of ferromagnetic metallic objects including steel pipes and structures; non-metallic utility infrastructure including gas pipelines, concrete sewer lines, telecommunication lines, and cable systems outfitted with RF tracer lines and transmitters; energized AC and DC power cable systems; and determining the approximate range, relative azimuth, and elevation of the sensors relative to the detected utility or object. The system also supports automatic cessation of drilling operations by combining the warning information with microprocessor control of drill string rotation and thrust.

DESCRIPTION OF THE PREFERRED EMBODIMENT

Figure 1:
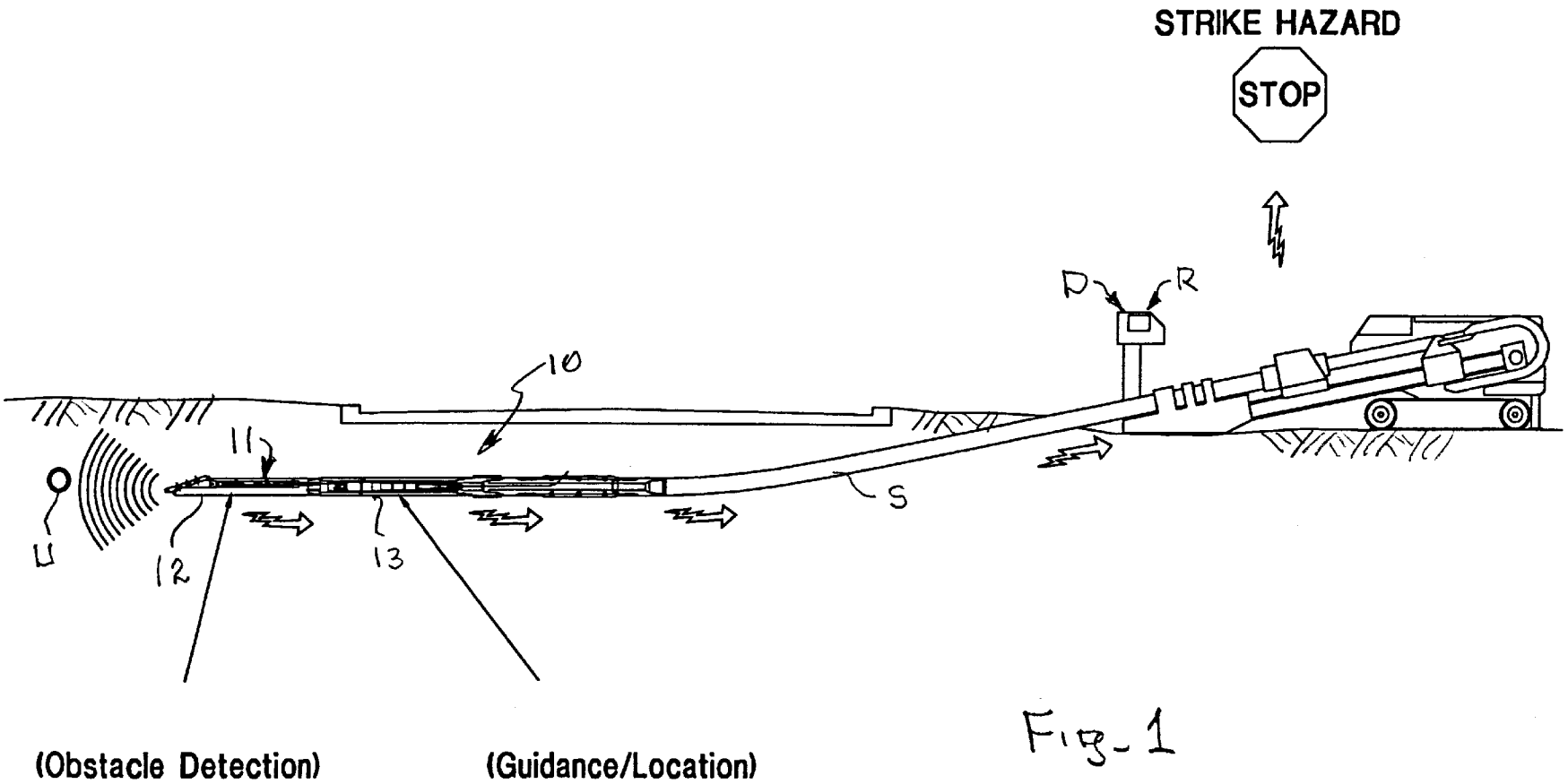
FIG. 1 is a schematic illustration of the downhole buried utility sensing and data transmission system in a drill string showing the utility sensing unit, electromagnetic data transmission unit, and surface processing and display system in accordance with the present invention.

A brief description of the overall system and its operation will be undertaken first followed by a more detailed description of the apparatus and circuitry used to carry out the invention. As represented schematically in FIG. 1, the downhole buried utility sensing and electromagnetic data transmission system 10 includes a utility sensing unit 11 mounted within a non-magnetic jet cutting head or drill head 12 of the type typically used in directional boring operations on the front end of a drill string S or in a sub immediately behind the head adjacent to the telemetry/data transmission unit 13. This ensures that the sensors are located as close to the leading tip of the drilling assembly as possible where they can provide the earliest indication that a buried utility U or obstacle is in the near vicinity of the bore path. The signals representing the physical signatures of the buried utilities or obstacles being detected are attenuated through the earth. The attenuation of the signal follows a power law based mathematical relationship that can be exploited to provide ranging and location estimates, as described hereinafter. Also shown in FIG. 1 is the surface processing and display system D.

In a preferred embodiment, the data transmission unit 13 comprises a wireless, electromagnetic telemetry unit that impresses a digitally encoded message upon the drill string using frequency shift keying of the electromagnetic waves as taught by McDonald et al, U.S. Pat. No. 5,467,083, hereby incorporated herein in its entirety by reference. The transmitted message is picked off at the surface by a signal receiver-demodulator unit R. The demodulated message is further processed in the up hole microprocessor and displayed to the operator. As described fully in U.S. Pat. No. 5,567,083, the drill pipe functions as an electrical lossy single conductor with the earth forming the electrical return path; and the data transmission means includes a microprocessor controlled frequency synthesizer for producing frequencies in the range of from about 15 Hz to about 100 Khz for transmission of data. The transmitter encodes the data from a probe (in the present invention from the sensor array) into electromagnetic signals generated by the frequency synthesizer in the form of simultaneously encoded multiple frequencies impressed simultaneously on the drill pipe. The receiver-demodulator located at the earth surface receives and decodes the signals from the encoded multiple frequencies from the transmitter.

Figure 2:
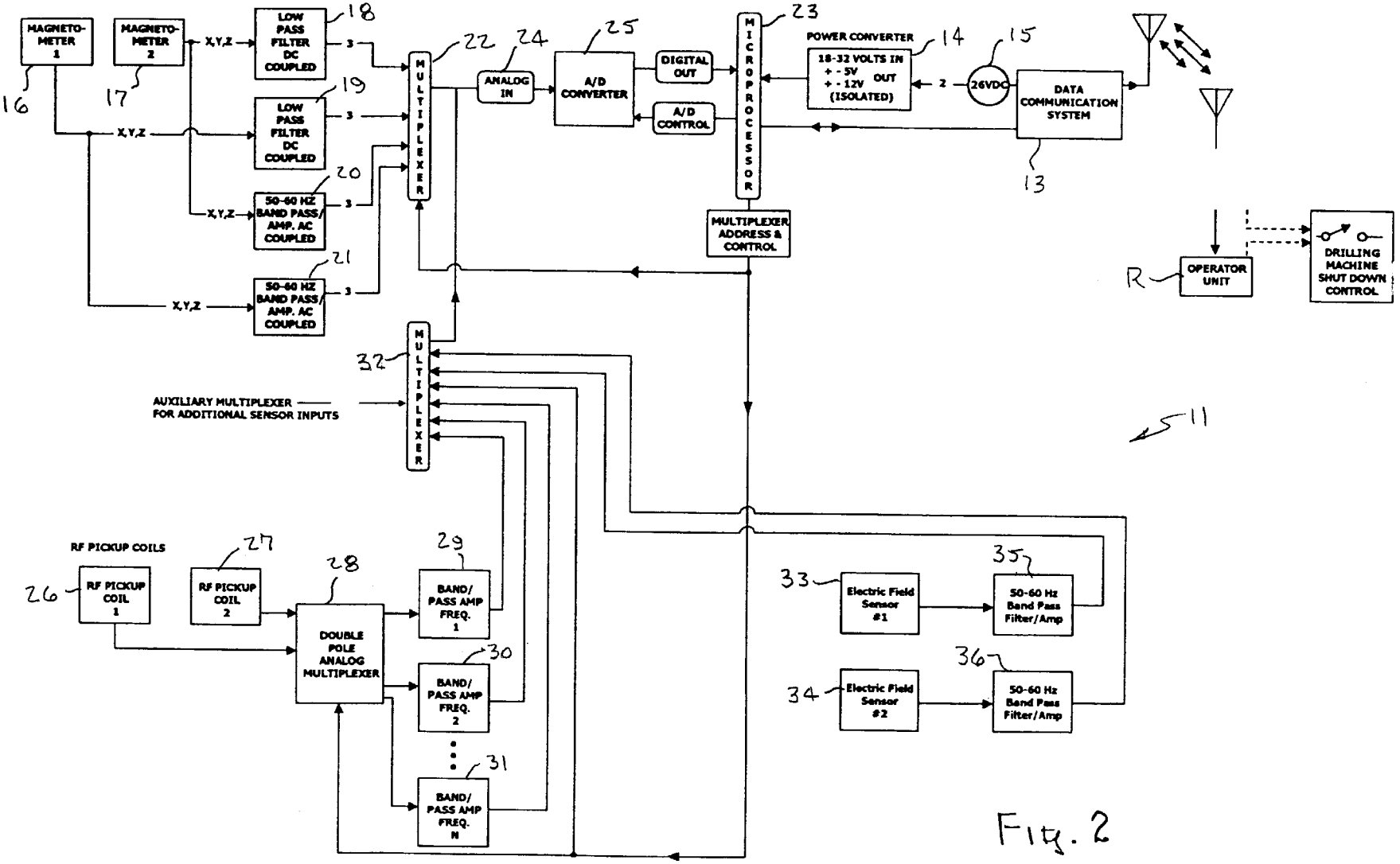
FIG. 2 is a schematic block diagram showing the sensors and data gathering and data processing components of the of the downhole buried utility sensing and data transmission system which are carried in the downhole drill head.

It should be understood that the present invention differs from U.S. Pat. No. 5,467,083 in that with the present system, the sensors respond to stimuli based on the materials used to construct the utility lines (pipes and cables) or from the energy associated with transmission of the particular utility service and the demodulated message provides specific information related to the particular different types of buried utilities detected, the level of alarm and the distance between the drill head and the obstacles. The present system may also be used with other electromagnetic data transmission systems, an RF system such as used with locator sondes, or other suitable systems using encoding protocols for steering the tool and transmitting the information to the control point, for example, phase shift keying, pulse width modulation, amplitude modulation or frequency shift keying. The data can also be communicated using a direct wire line link which transmits analog or digitally encoded data Referring now to FIG. 2, the electronic elements of the buried utility sensing system 11 are illustrated schematically in block diagram. The utility sensing unit 11 is connected to the data transmission unit 13 through a power converter 14 and a battery pack 15 which supplies both power to operate the utility sensing unit and power to support communications between the sensing unit and the data transmission unit. The battery pack 15 is a commercially available 26 V DC battery and the power converter 14 is a power-conditioning subsystem which takes DC power from the battery pack and converts it to multiple voltages for use by the system electronics.

The first type of sensors include two, spatially separated tri-axial magnetometers 16, 17 for vector measurement of both the earth's DC magnetic field as well as lower frequency alternating magnetic fields produced by current flow (i.e., 50–60 Hertz power). This is accomplished by switching between low pass filters 18,19 and bandpass filters 20, 21 using a multiplexer 22 controlled by the downhole onboard microprocessor 23. Each channel of bi-polar, analog data 24 (Hx1, Hy1, Hz1, Hx2, Hy2, and Hz2) are individually read and converted to digital data via an A/D converter 25.

The second type of sensors include dual, tuned radio frequency (RF) pickup coil sets 26,27 with high permeability cores to detect electromagnetic (EM) fields of specific frequencies. The RF coil sets are tri-axial sensors that are used to measure the strength of radio signals employed in point source locating sondes as well as tracing signals applied along the length of buried telecommunications cables. A wide rang,e of tracing frequencies are commercially used with 8 KHz and 33 KHz being very common. As a result, the preferred embodiment allows detecting several different frequencies. This is accomplished by coupling the RF pickup coil sets 26, 27 through a double pole analog multiplexer 28 with several different high Q bandpass filter and amplifier circuits 29, 30, 31, each selective to a narrow frequency capture band. As with the magnetometers 16, 17, the various RF readings are performed sequentially using the multiplexer circuit 28 controlled by the downhole onboard microprocessor 23 and are individually read and convertor to digital data via an auxiliary multiplexer 32 and the A/D converter 25. Level detection circuitry is used to monitor the presence and strength of EM signals of the frequencies of interest. When the received level exceeds a user-defined level, the operator is alerted to the presence of such signals. Then the differential signal level between the two coil sets is monitored to provide ranging information.

The third type of sensors are capacitive-type electric field sensors 33, 34 coupled through 50–60 Hz bandpass filter/amplifiers 35, 36 and multiplexer 32 to the A/D converter 25. The electric field sensors 33, 34 measure the electric field strength produced by energized power cables. These sensors allow detection of 50- and 60 Hz power cables and provide a further benefit to discern the difference between ferrous pipes and power cables. This is possible because ferrous pipes do not possess significant electric fields. However, these ferrous pipes do modify the earths local magnetic field.

By combining the magnetic and electric field measurements it is therefore possible to differentiate pipe from energized power cables. In a preferred embodiment, the input stage to the sensor unit is expandable to support the inclusion of additional sensors which could detect other types of obstacles.

The microprocessor 23 is a fully programmable microcontroller which executes the controlling software to sample data from the sensors, manage power consumption, interface with the telemetry system, assemble the message containing alarm information sent to the telemetry system, perform ranging calculations, and discriminate between relevant and non-relevant signals based on user-definable thresholds and parameters. The user-programmable software in the microcontroller 23 makes the detection and alarm thresholds user-definable based on site-specific considerations.

The individual sensors are periodically read under microprocessor control via the analog-to-digital convertor 25. The information is continuously processed by the microprocessor 23 which contains various subroutines that determine if obstacles are in the immediate vicinity of the drill head by comparing the sensor readings to pre-set thresholds. Should these thresholds be exceeded, the microprocessor sends information to the data transmission system 13. The transmitted message is picked off at the surface by a signal receiver-demodulator unit R. The demodulated message is further processed in the up hole microprocessor and displayed to the operator. Should the utility and drill head become too close, detected through both ranging calculations as well as the rate of change in received signal strength, the uphole microprocessor can be used to automatically stop the forward advance and rotation of the drill string. This can be accomplished in a variety of ways including servo-controls on the drill rig electric-over-hydraulic operator controls.

Figure 3:
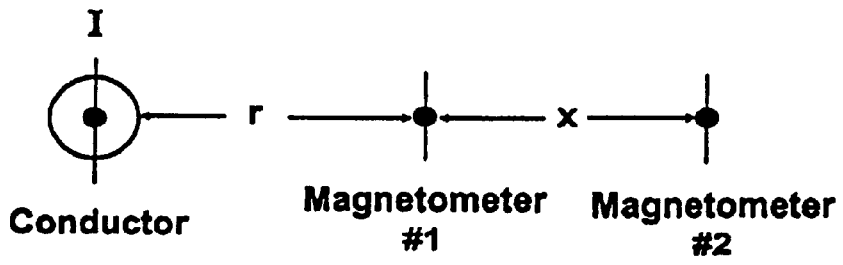
FIG. 3 is a schematic illustration showing a pair of magnetometer sensors separated a fixed distance illustrating the calculation of magnetometer AC output voltages when separated by a fixed distance away from energized power cables.
Figure 4:
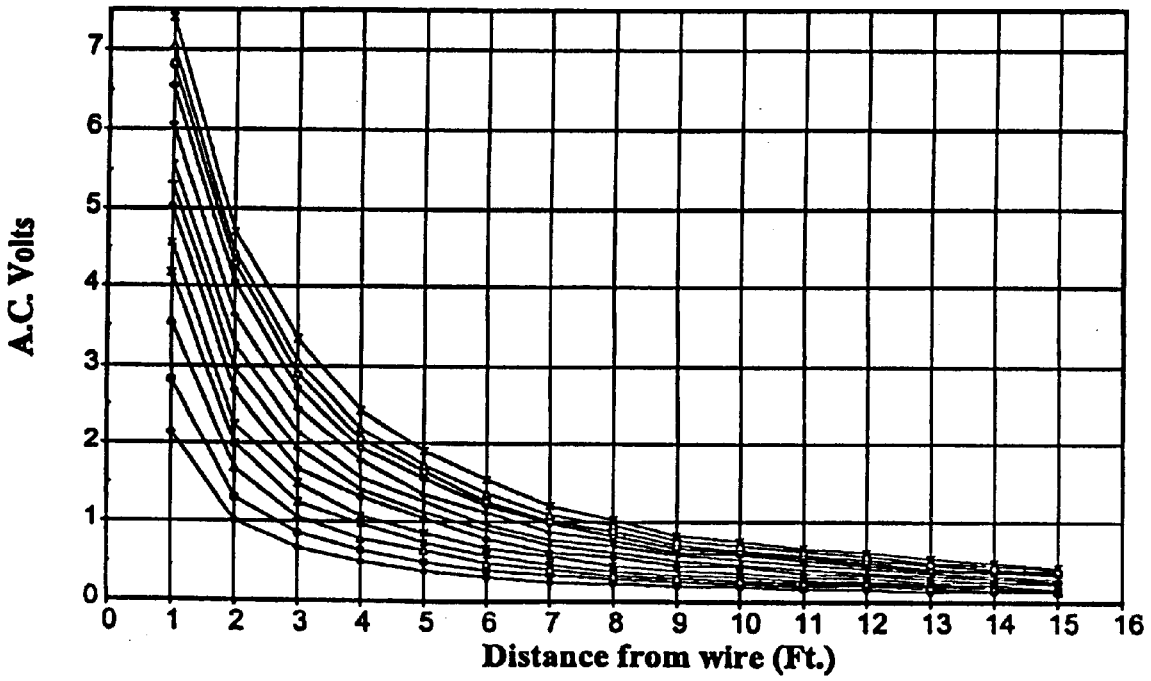
FIG. 4 is a graph illustrating the magnetometer AC output voltages relative to the distance from an energized power cable.

The sensor elements are provided in pairs with one set of sensors disposed at the forward end of a mandrel and the second set at the rearward end of the mandrel (described hereinafter). The spatial separation of the sensor sets provided by the present invention allows computations to be made as to the distance of the sensor assemblies (and therefore the drill head) from a particular utility. For example, using two, spatially separated sets of tri-axial, mutually perpendicular magnetometers allows one to fully measure both DC and AC magnetic field vectors. This information is then processed to compute the separation distance from AC and DC energized cables as follows:

As illustrated in FIGS. 3 and 4, current through a long, straight electrical conductor produces a magnetic field. The intensity of this magnetic field, denoted H, is given by the following equation:

$$H = \frac{\mu_0 I}{2\pi\mu r}$$

where:

$\mu_0$=magnetic permeability in a vacuum ($4\times10^{-7}$ Tesla-meter/ampere), $\mu$=magnetic permeability of the medium between the conductor and radius, r, I=current in amperes, and r=radial distance from the conductor in meters.

The equation shows that the magnetic field intensity is directly proportional to the current and inversely proportion to the radial distance from the conductor through which the current flows. Thus, it is possible to employ two magnetometers, separated by a known, fixed distance X, to compute the distance away from energized power cables.

For situations where the boring head is perpendicularly approaching the energized cable the distance between the cable and the lead magnetometer is calculated as follows using the relationship:

$$H_1 = \frac{\mu_0 I}{2\pi\mu r}$$

$$H_2 = \frac{\mu_0 I}{2\pi\mu(r+x)}$$

$$\frac{H_2}{H_1} = \frac{r}{(r+x)}$$

Solving for r, we have:

$$r = \frac{\left(\frac{H_2}{H_1}\right)x}{1-\left(\frac{H_2}{H_1}\right)}$$

Ranging calculations can also be made for other sensor set/magnetic field emitter source orientations using vector computations. It is also noted that similar ranging calculations can be made for the radio frequency receivers and the electric field measurements providing two spatial sensor sets are used and that the sensors provide vector measurement capabilities.

The mathematical routines apply to both AC and DC currents. For DC currents, the generated field will be superimposed on the earth's field. Thus, depending on the position of the conductor and the direction of current relative to magnetic north, the presence of an energized cable can be detected by the magnetometer as either an increase or decrease in the total field magnitude as well as a change in the vector component distribution which can be directly measured or examined through the computed magnetic field dip angle. Table A below lists the radial distance needed to produce 5 and 10% changes in magnetic field strength for various DC current values.

TABLE A

Magnetic Field Changes caused by DC Current

| Current (Amperes) | Radial Distance for 10% Change in H-Field | Radial Distance for 5% Change in H-Field |
|---|---|---|
| 24 | 2.4 Feet | 3.2 Feet |
| 40 | 3.0 Feet | 5.0 Feet |
| 60 | 4.2 Feet | 8.3 Feet |
| 80 | 6.0 Feet | 9.8 Feet |
| 100 | 7.2 Feet | 12.0 Feet |

The output (voltage), $V_1$, of the first of each pair of sensors, at a particular point in space, is given by the following equation:

$$V_1 = \frac{A}{r}$$

Where A is a constant of proportionality characteristic to the physical phenomenon being measured. The constant involves relative and absolute permeability of the transfer medium, and the strength of the source signal, and electronic system gain. "r" is the radial distance from the source. The second sensor of the pair is affixed a constant distance, x, from the first. Its response will be (given by $V_2$ as follows:

$$V_2 = \frac{A}{(r+x)}$$

The constant "A" will remain the same. The two expressions can then be combined to solve for the distance "r". Rules of geometry must be applied to account for the effects of off-axis approach paths. This is mathematically possible in three dimensional space and implemented in software to present range, elevation and azimuth information to the user. This process utilizes directional data from the host navigation system.

The responses of the sensors are modeled to verify the range versus the rate of change of sensor response behavior. Thus, the rate of change of individual sensor response can be used as a secondary check to verify ranges calculated as described above.

The magnetometers, each with three independent fluxgates on mutually-orthogonal axes, are used to monitor both AC and DC magnetic fields. By observing the DC vector field in the locale of the boring operation, a benchmark (or threshold DC level for each component for the magnetometers) can be established for the job. The DC vector field is monitored throughout the boring operation by the sensor package. Deviation from the established benchmarks indicates a perturbation in the earth's magnetic field and thus the presence of a ferromagnetic object (e.g. steel or iron pipe) or DC electromagnetic entity (e.g. energized DC power cable). Analysis of vector changes between the two sets of magnetometers provides ranging and relative position information.

These same magnetometers may also be used to detect the presence of energized AC power cables. Energized AC transmission and distribution power cables will emanate a magnetic field which varies sinusoidally at 60 Hz. By filtering the AC-coupled output of the magnetometers and monitoring the 60 Hz component, the presence of 60 cycle power cables can also be detected.

Thus, the sensor unit can detect the presence of the following obstacles: ferromagnetic metallic objects including but not limited to steel pipes and structures, non-metallic utility infrastructure such as gas pipes and concrete sewer lines fitted with RF tracer lines or transmitter sources, telecommunication lines and other cable systems fitted with RF tracer systems, and energized AC and DC power cable systems. The sensor unit makes a determination of the approximate range, relative azimuth and elevation to the obstacle, and transmits this information in real-time to the personnel on the surface informing them of the presence and nature of the object thereby allowing them to redirect the boring operation to avoid a collision or strike.

The sensor system operation is independent of the host telemetry/directional navigation system used to steer the boring tool and transmit the information to the controlling/origination point of the boring operation. The system is always active, monitoring the outputs of the individual sensors and analyzing for changes in these outputs which could indicate that an obstacle is near. When no alarm conditions are detected, the system does not send data to the user thereby remaining transparent to normal boring operations. The sensor package is capable of maintaining two-way background communication with the host directional/telemetry system to verify proper operation of the sensor unit.

Figures 5, 6, 7:
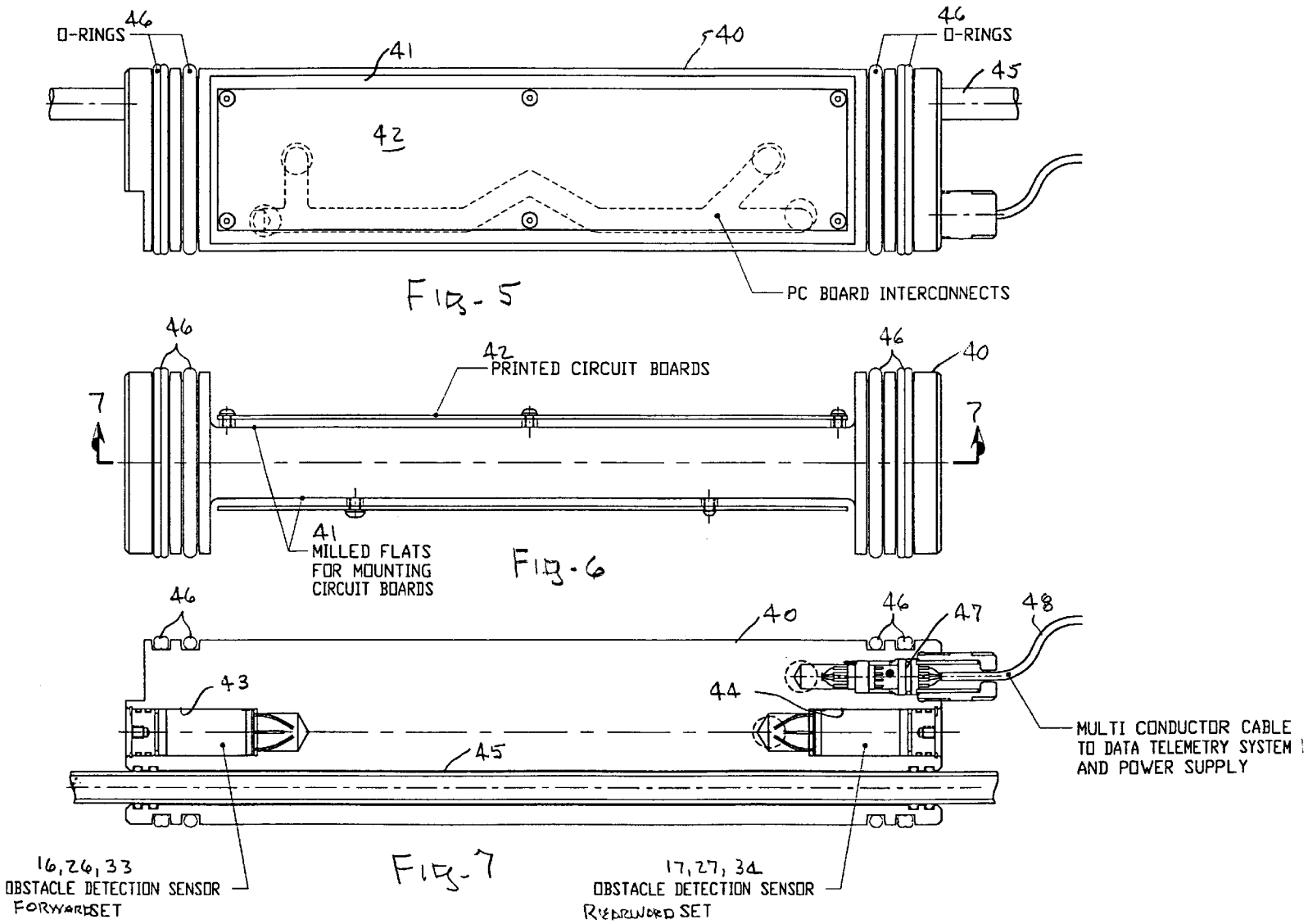
FIGS. 5 and 6 are a side elevation and top plan view, respectively, of the mandrel on which the sensor elements and their associated printed circuit boards are mounted.
FIG. 7 is a longitudinal cross section through the mandrel taken along line 7—7 of FIG. 6 showing the sensor elements and the fluid flow conduit extending through the mandrel.
Figure 8:
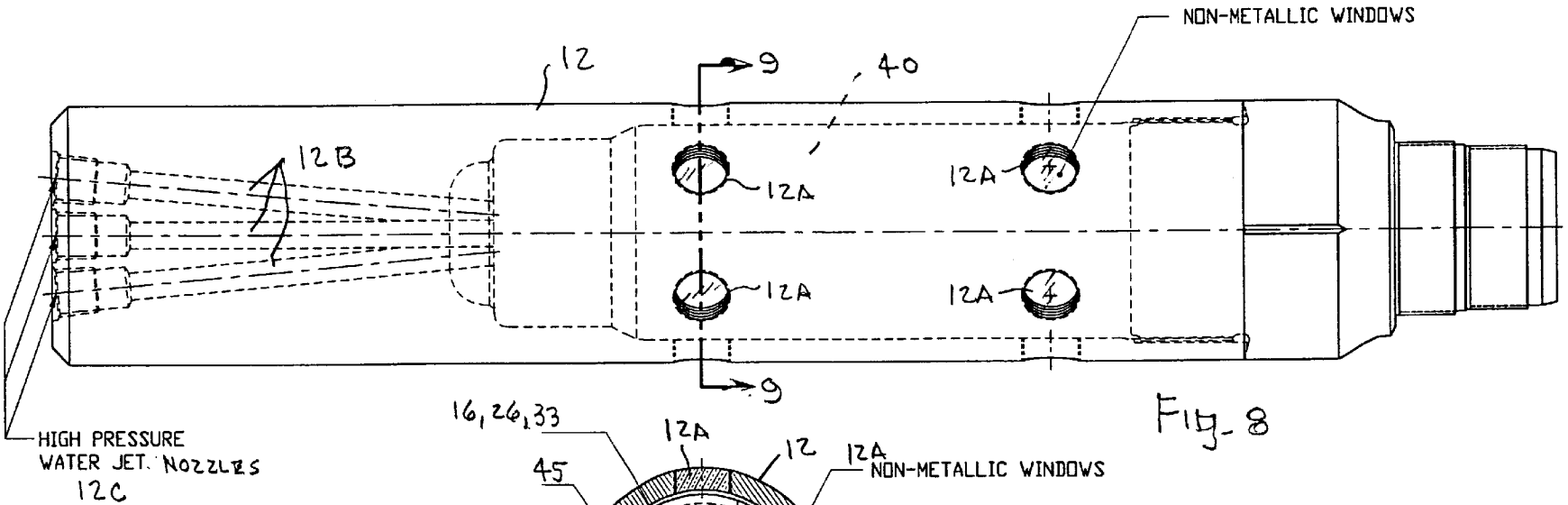
FIG. 8 is a top plan view of a drill head with the mandrel installed therein with the drill head shown somewhat schematically.
Figure 9:
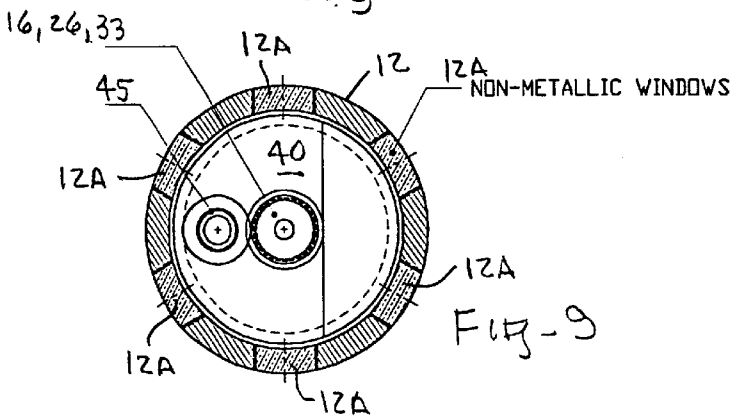
FIG. 9 is a transverse cross section taken along line 9—9 of FIG. 8 showing the non-metallic windows in the drill head assembly.

Referring now to FIGS. 5, 6, and 7, the electronics and sensors are mounted on a non-magnetic mandrel 40 which fits like a cartridge into a non-magnetic jet cutting head typically used in directional boring operations. The mandrel 40 has milled flats 41 on which printed circuit boards 42 carrying the electronics (not shown) are mounted. The mandrel 40 has holes 43, 44 drilled in opposed ends in which the sensors 16, 26, 33 and 17, 27, 34 are affixed. The sensor elements are provided in pairs with one set of sensors disposed in the hole 43 at the forward end of a mandrel and the second set in the hole 44 at the rearward end of the mandrel. The mandrel is designed and constructed such that all sensors and electronics are protected from the shock and vibration loads seen at the jet cutting head. The mandrel 40 has a fluid flow conduit 45 extending longitudinally therethrough which is in fluid communication with the fluid flow path in the jet cutting head or drill head that supports the delivery of pressurized drilling fluid from the drill string, through the drill head which exists out of nozzles at the drill face. The mandrel 40 is provided with O-ring seals 46 on its outer circumference which prevent the pressurized fluid from contacting either the sensors or their associated electronics. The sensors and associated electronics of the sensing unit 11 is connected to the data transmission unit 13 by means of a connector 47 and an electrical cable 48 connected at the rearward end of the mandrel 40. The cable 48 supplies both power to operate the obstacle sensing unit from battery pack as well as power to support communications between the sensing unit and the data transmission unit As shown in FIGS. 8, 9, 10 and 11, the mandrel 40 is mounted inside of the non-magnetic jet cutting head or drill head 12. The drill head 12 is constructed of non-magnetic material so as to not interfere with the ability of the magnetometers to detect magnetic fields. The non-magnetic dill head has a series of circumferentially spaced non-metallic windows 12A in the immediate vicinity of the sensors to provide a minimally shielded, energy propagation path from the buried utilities to the sensing elements. These windows 12A are formed of holes drilled into the housing sidewall into which are installed non-metallic elements such as sapphire windows. The windows 12A allow certain sensors to detect the presence of the phenomena characteristic to certain underground utilities.

Figure 10:
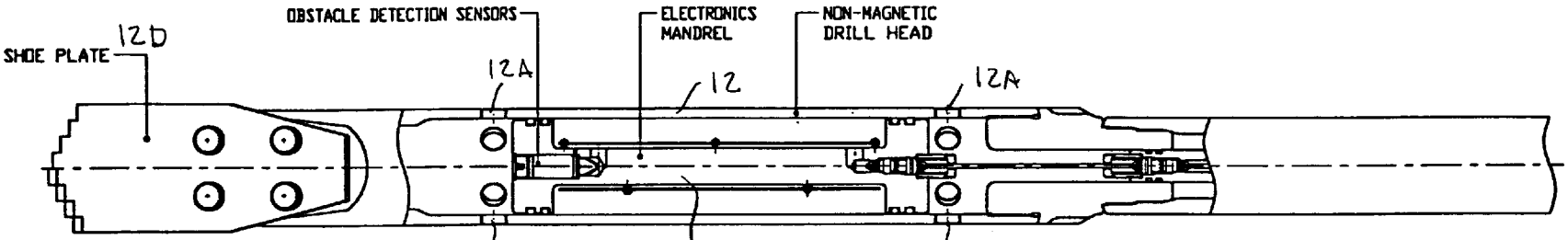
FIG. 10 is a top plan view of the drill head with the mandrel installed therein with the drill head shown in more detail.
Figure 11:
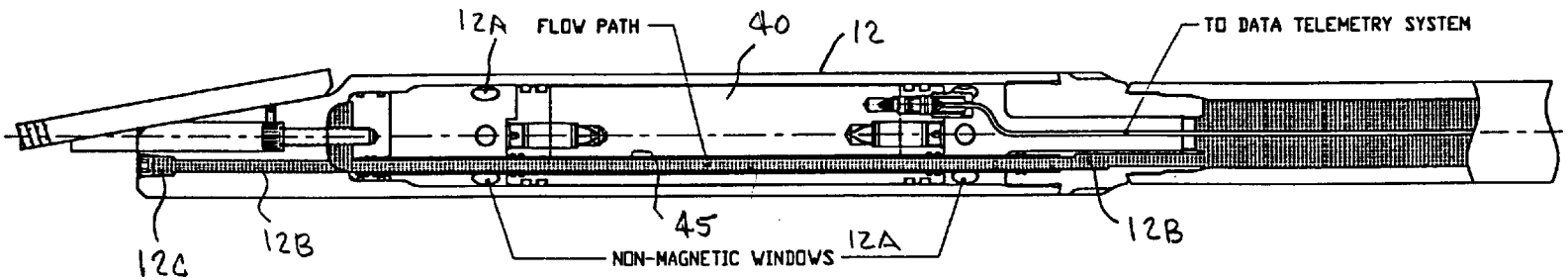
FIG. 11 is a longitudinal cross section taken along line 11—11 of FIG. 10, showing the fluid flow path through the mandrel and drill head assembly.

FIGS. 10 and 11 show the jet cutting head 12 in more detail. The fluid flow path is represented by the shaded area in FIG. 11. The pressurized drilling fluid from the drill string is conducted through passageways 12B in the drill head 12 and through the mandrel 40 via conduit 45 and exits out of nozzles 12C at the drill face beneath the guide shoe 12D.

The sensor unit accommodates two-way communication with the user to enable certain site-specific parameters to be set. The earth's DC magnetic field varies over the surface of the planet, but in a given location will be constant. Thus, the user can set the "ambient" levels from which deviations will be measured. Other parameters can be user selected as well. These are: sensor sampling rate, and communications protocol details to interface with the telemetry platform being used.

How the system handles variations in the measured parameters (and therefore alarm indications) can be set by the user. The user can choose from three options: (a). The user can be notified if any of the measured parameters exceed or fall below a programmed threshold—absolute level; (b). The user can be notified if a predetermined rate of change is exceeded—absolute value of the gradient; or; (c). The user can be notified if certain parameters fall outside of a specified envelope (maximum and minimum). This is useful when a boring operation will be conducted intentionally near other underground entities, such as in a right-ofway where other pipelines are buried. The monitoring of upper and lower limits of sensor outputs will allow the user to keep a specified distance away from the pipeline without getting too far away from it. The same approach applies to drilling near other underground utilities.

Depending on which alarm structure is established by the user, the signal receiver/decoding device at the surface can be configured to interface directly with drill rig controls to automatically cease advance and rotation of the drill rig to prevent a strike or contact with a buried utility.

Typically directional bores are done in two steps. in the first, a precisely guided pilot bore is drilled. In the second step, the pilot bore is enlarged using a hole opener or backreamer to increase the diameter of the bore to accommodate the product pipe to be installed. Neither the pilot bore nor the backreamer should strike adjacent utilities. The sensors are designed such that they can detect obstacles in the near vicinity of the borepath. This includes objects directly in line with the bore in addition to those sufficiently close which could be contacted by the backreamer during the hole enlargement step.

While this invention has been described fully and completely with special emphasis upon a preferred embodiment, it should be understood that, within the scope of the appended claims, the invention may be otherwise than is specifically described herein.

We claim:

1. A downhole buried utility sensing and data transmission system for detecting and communicating data related to a variety of different types of buried utilities and objects and the approximate distance between the detected utility or object and a drilling head connected therewith, the system comprising:

a sensor array disposed in a housing mounted closely adjacent to a drilling head at the lower end of a drill pipe, said sensor array comprising:

metallic sensor means for detecting the presence of ferromagnetic metallic objects including steel pipes and structures;

RF sensor means for detecting the presence of non-metallic utility infrastructure including gas pipelines, concrete sewer lines, telecommunication lines, and cable systems by detecting RF tracer lines and transmitters associated with the respective utility;

electric field sensor means for detecting the presence of energized AC and DC power cable systems; and means for determining the approximate range, relative azimuth, and elevation of the sensor array relative to the detected utility or object; and said sensor array adapted to be connected with data transmission means in said drill pipe lower end for transmitting analog or digitally encoded data signals to the surface.

2. The buried utility sensing and data transmission system according to claim 1, further comprising:

programmable microcontroller means with controlling software to sample said data signals transmitted from said sensor means, manage power consumption, interface with a telemetry system used to steer the drilling head, assemble message containing alarm information sent to the telemetry system, perform ranging calculations, and discriminate between relevant and non-relevant signals based on user-definable thresholds and parameters; and power conditioning means for receiving DC power from a battery and converting it to multiple voltages for use by the system electronics.

3. The buried utility sensing and data transmission system according to claim 1, wherein said RF sensor means comprise inductive pickup coils for detecting the presence of non-metallic utility infrastructure including gas pipelines, concrete sewer lines, telecommunication lines, and cable systems by detecting RF tracer lines and transmitters associated with the respective utility.

4. The buried utility sensing and data transmission system according to claim 1, wherein said electric field sensor means comprise electric field sensors for detecting the presence of energized AC and DC power cable systems.

5. The buried utility sensing and data transmission system according to claim 1, wherein said electric field sensor means comprise magnetometers with three independent fluxgates on mutually-orthogonal axes for detecting the presence of energized AC and DC power cable systems.

6. The buried utility sensing and data transmission system according to claim 1, wherein said metallic sensor means comprise magnetometers with three independent fluxgates on mutually-orthogonal axes for detecting the presence of ferromagnetic metallic objects including steel pipes and structures.

7. The buried utility sensing and data transmission system according to claim 1, further comprising means for communicating a signal to controls on a surface drill rig when pre-set alarm thresholds are exceeded to automatically stop the rotation and forward advance of said drill head to prevent contact with buried utilities or other underground obstacles without human intervention.

8. The buried utility sensing and data transmission system according to claim 1, wherein said sensors are disposed in said housing to scan both radially around said drilling head and axially in front of said drilling head to assure sufficient clearance between buried utilities and a pilot hole drilling head and a final size bore formed during successive back reaming operations.

9. The buried utility sensing and data transmission system according to claim 1, further comprising analog or digitally encoded data transmission means connected with said sensor array selected from the group consisting of electromagnetic data transmission, RF data transmission, direct wire line transmission systems utilizing phase or frequency shift keying, pulse width modulation, amplitude modulation.

10. The buried utility sensing and data transmission system according to claim 9, wherein said drill pipe functions as an electrical lossy single conductor with the earth forming the electrical return path; and said data transmission means comprises a microprocessor controlled frequency synthesizer for producing frequencies in the range of from about 15 Hz to about 100 Khz for transmission of data;

transmitter means for encoding said data from said sensor array into electromagnetic signals generated by said frequency synthesizer in the form of simultaneously encoded multiple frequencies impressed simultaneously on said drill pipe; and a receiver-demodulator located at the earth surface for receiving and decoding said signals from said encoded multiple frequencies from said transmitter means.

11. The buried utility sensing and data transmission system according to claim 1, wherein said metallic sensor means, said RF sensor means, and said electric field sensor means each comprise a pair of sensor elements with a first and second sensor element disposed a fixed distance apart sufficient to facilitate determination of said sensor array relative to each respective type of detected utility or object.

12. The buried utility sensing and data transmission system according to claim 11, wherein the response output voltage $V_1$, of the first one of each of said pair of sensor elements at a particular point in space, is determined by the equation:

$$V_1 = \frac{A}{r}$$

Where A is a constant of proportionality characteristic corresponding to the physical phenomenon of the utility or object being measured including relative and absolute permeability of the transfer medium, the strength of the source signal, and electronic system gain, r is the radial distance from the utility or object being measured; and the second one of each of said pair of sensor elements is affixed a constant distance, x, from the said first one and its response output voltage $V_2$ is determined by the equation:

$$V_2 = \frac{A}{(r + x)}$$

wherein the constant A remains the same and the two equations are combined to solve for the distance r.

* * * * *